US006435262B1

(12) United States Patent
McVane

(10) Patent No.: US 6,435,262 B1
(45) Date of Patent: Aug. 20, 2002

(54) FOUNDRY SAND

(75) Inventor: Duane Alan McVane, Shawano, WI (US)

(73) Assignee: New Ideas, LLC, Kaukauna, WI (US)

( * ) Notice: Subject to any disclaimer, the term of this patent is extended or adjusted under 35 U.S.C. 154(b) by 0 days.

(21) Appl. No.: 09/810,855

(22) Filed: Mar. 16, 2001

(51) Int. Cl.[7] ..... B22C 5/18
(52) U.S. Cl. ..... 164/412; 164/5
(58) Field of Search ..... 164/412, 5, 1; 366/14, 38, 40

(56) References Cited

U.S. PATENT DOCUMENTS

| | | | | |
|---|---|---|---|---|
| 3,070,858 | A | 1/1963 | Deacon | |
| 3,646,987 | A | 3/1972 | Schumacher | 164/5 |
| 4,039,169 | A | 8/1977 | Bartholomew | 259/10 |
| 4,056,259 | A | 11/1977 | Richard | 366/15 |
| 4,163,000 | A | 7/1979 | Kashima et al. | 260/29.6 S |
| 4,174,906 | A | 11/1979 | Richard | 366/6 |
| 4,322,168 | A | 3/1982 | Hartung et al. | 366/15 |
| 4,329,063 | A | 5/1982 | Edwards | 366/34 |
| 4,394,172 | A | 7/1983 | Scheuble et al. | 106/38.5 D |
| 4,403,863 | A | 9/1983 | Fukushima et al. | 366/8 |
| 4,560,281 | A | 12/1985 | Harris et al. | 366/15 |
| 4,764,019 | A | 8/1988 | Kaminski et al. | 366/15 |
| 4,904,089 | A | 2/1990 | Dunton et al. | 366/6 |
| 5,158,130 | A | 10/1992 | Sahari | 164/528 |
| 5,330,265 | A | 7/1994 | Keating, Jr. et al. | 366/7 |

*Primary Examiner*—Kuang Y. Lin
(74) *Attorney, Agent, or Firm*—Wilhelm Law Service; Thomas D. Wilhelm

(57) ABSTRACT

Apparatus and methods for preparing foundry sand mixes, using a pre-mix tank to pre-mix water and particulate bond material to make a water/bond slurry, then feeding the slurry to a mullor or other foundry sand mixer. The slurry is received in the mullor/mixer, mixed with return sand, and then discharged for use in making foundry molds. Preferably, the particulate bond material is added to the pre-mix tank as a falling stream of such particles, and a disperse spray of water is projected onto the particles with sufficient gentleness to not deleteriously distract the particles from their downward path.

25 Claims, 3 Drawing Sheets

FOUNDRY SAND

BACKGROUND

In foundries, metal is poured into molds which are fabricated from special mixes of sand and special-purpose bond/adhesive compositions. This invention addresses apparatus and methods for making, using, and recycling the sand mix. The invention specifically addresses use of particulate bond materials which remain in particulate form when mixed with water, and apparatus and methods for controlling dust which may be generated in the process of making and using such sand mixes.

In making the sand mix, sand is mixed with water, and with the bond material. The bond material is a finely-powdered mixture of e.g. bentonite clay, coal, and a combination of compatibilizers, stabilizers, wetting agents, and the like.

In conventional sand preparation, the sand mix is generally made up in a mullor. In general, a mullor is a special purpose mixing tank. Sand and bond material are metered into the mullor at specified ratios or rates. Water is added to the tank in defined quantity. A typical charge to the mullor is comprised primarily of return sand, with make-up quantities of fresh bond material and fresh sand, in combination with sufficient water to bring the resultant water content of the mix to the desired level.

A mix motor or the like rotates mixing paddles and/or wheels inside the mullor to mix the respective components placed therein. The mixing of sand in the mullor can be either a batch process or a continuous stream process. The exiting sand is preferably tested against a standard, and adjustments to the dry or wet ingredients currently in the mullor are made in response to results of those tests of completed product which have recently exited the mullor.

Typical bond material is a finely powdered particulate material, so fine as to easily become airborne as dust in a gaseous environment such as the air inside the mullor. Such particulate bond material is in general smaller than 200 mesh, and is typically added to the mullor in dry form, and thus is susceptible to becoming air borne until such time as the respective particles become wetted with the water. Indeed, that wetting process is part of the function of the mulling operation. In general, the mullor should accomplish the tasks of uniformly dispersing the fresh sand and fresh bond material, and substantially wetting all bond and sand particles.

In general, the sand particles tend to be relatively hydrophilic while the bond material particles tend to be relatively hydrophobic. Thus, the water tends to be more attracted to the relatively larger sand particles than to the relatively smaller bond material particles whereby the relative tendency for wetting sand particles with a given batch of water is greater than the relative tendency for wetting bond particles with the respective batch of water. Namely, absent an excess of water, the water is selective in tending to wet sand surfaces more readily than bond material surfaces, thereby running the risk that a significant fraction of the bond particles may not be wetted. Accordingly, one of the objects of this invention is to increase the fraction of the fresh bond particles which are effectively wetted by the water.

Typically, freshly-added bond material is fed into the mullor as a stream of dry particles, e.g. transported pneumatically or dropped by gravity into the mullor receptacle. As the dry particulate bond material enters the mullor receptacle in the conventional manner, a fraction of the bond material can and does become entrained in the air through which the bond material passes as the bond material drops to either the bottom of the tank or to a mass of sand, water, and/or other bond material already in the tank. In addition, to the extent bond material lands on underlying dry material already in the mullor, e.g. relatively dry return sand or previously added and still-dry bond material, the dropping dry bond material particles land on the bond material particles on the surface of such underlying material are free to become air-borne upon sufficient agitation or other disturbance, whether solid, liquid, or gaseous agitation. Indeed, so long as such small particles are not wetted, the particles readily go air-borne upon even mild agitation, much like edible grain flours.

Accordingly, one of the primary sources of dust in foundry operations is dry, or relatively dry, particulate bond material in the sand system. A first mechanism for such dust to become air-borne is bond material which becomes dispersed in the air inside the mullor as the bond material is added to the mullor, and as the bond material is in general being mixed with the sand and water. Since bond material, sand, and water are repeatedly or constantly being added to the mullor, and discharged from the mullor, there is an ongoing flow of air into the mullor, and out of the mullor. If no controls are placed on flow of such air, much of the air which exits the mullor will pass to ambient, and will carry with it substantial quantities of-air-borne particulate bond material pollution.

Accordingly, it is well known to provide dust collection apparatus as part of a sand system, for capturing particulate material which becomes entrained in the air in the mullor and in other parts of the sand system. Indeed, typical foundry sand systems generate waste particulate bond material amounting to about 25 percent to about 50 percent by weight of the particulate make-up bond material fed to such sand systems, as it is common that such quantity is eventually collected in the dust collection system.

In addition to providing for addition of make-up quantities of bond material, provisions are also conventionally made for addition of make-up quantities of sand. Sand can be lost e.g. as dust. However, the usefulness of the sand is degraded with use. Accordingly, there is a need to routinely and regularly remove used sand from the sand system and to replace such used sand with fresh sand, or regenerated sand. As used herein, "regenerated sand" refers to sand which has been removed from the sand system use cycle, and which has been regenerated by e.g. washing, removal of non-sand materials, sizing, and the like.

It is common for the sand system to be operated on a positive replacement basis, wherein sand is routinely removed from the system, and replaced by adding sand at e.g. the sand mixing stage of the sand system. While sand can be selected for removal according to a number of factors, it is common to pass the sand through sizing screens at the work stations where the sand molds are broken away from the cast metal parts, and to remove any chunks of sand which do not pass through the sizing screens. In addition, it is common to deposit the return sand in one or more surge tanks, and to remove from the system any sand which accumulates in the surge tanks above a pre-set volume level.

Such accumulation can occur, for example, where the sand mix prepared at the sand mixing station contains a first pre-determined fraction of return sand and a second pre-determined fraction of fresh make-up sand. Where the quantity of the fresh make-up sand is greater than the quantity of sand lost in use of the sand system, the overall quantity of sand in the sand system potentially increases by the difference. It is such difference which represents the quantity of sand which is removed from the surge tanks, thereby to balance the quantity of sand leaving the sand system with the quantity of sand entering the sand system at the sand mix process.

A second locus for generation of such air-borne bond material, e.g. as dust, is in the sand return system, especially at the entrance to the sand return system.

In general, material so collected in a dust collection system which is connected to a such sand system cannot be economically recycled into the sand system, and is thus sent to land fill as waste. Such waste adds to the cost of the process, in that (i) bond material purchased for the purpose of making sand mix is sent to land fill either prematurely before utility of such bond material is exhausted, or without ever being used at all as part of the sand mix; and in that (ii) the cost of the land filling operation is greater than a minimum threshhold amount theoretically required by foundry operations.

In addition, bond material which is not wetted, and wherein bonding properties are accordingly not activated by the water, but which is nonetheless captured as trapped particles in the. sand mix, in inactive and thus does not act in a bonding capacity in the sand mix, and thus can become inadvertently separated from the sand mix during mold casting and cooling. Such separation of bond material particles from the sand mix can leave voids and cavities in the mold, which enable development of inconsistencies in the metal parts molded using such molds. Such inconsistencies can affect the qualities, including strength properties, of sand molds made with such sand mix, and can correspondingly affect the ranges of various properties of metal parts in a population of such metal parts cast in molds made with such sand mix.

Known dust collection systems are capable of capturing substantial fractions of the dust so generated. However, as with all known dust collection systems, the cost of collecting the dust increases greatly as one increases the required fraction of the dust which is to be collected. Unless extreme measures are taken to collect absolutely all dust, and such measures are usually prohibitively expensive, some fraction of the dust always eludes collection and thus makes an incremental contribution to ongoing particulate pollution of the ambient air and thereby has a deleterious affect on air quality.

Since air pollution standards generally address absolute quantities of pollutants emitted, not fractions of the quantity of pollutant generated by the process of interest, when the quantity of particulates generated increases, the amount of collection effort required increases by a like amount, typically according to an asymptotic curve. Conversely, where the quantity of particulates generated is reduced, the amount of collection effort required can decrease by a like amount. Thus, there is an ongoing social and political incentive to reduce the quantity of particulate material which is released into ambient air. There is a corresponding financial incentive for the operator of such foundry to reduce the quantity of particulate material which is produced, and which must thus be controlled and/or captured as a result of the sand system and process.

In foundry systems of interest in this invention, the primary sources of the dust of interest are the bond material which is not wetted or otherwise captured by the water or the wetted sand, and bond material which is released at or after mold breakage.

Bond material particles which become wetted by water correspondingly have taken on increased weight of the water and are thus larger and more dense, whereby an increased level of energy is required to make such particles air borne. In addition, such wetted particles develop adhesive properties as a result of such wetting, which also serve to inhibit the particles becoming or remaining air borne when such particles are in contact with each other or with e.g. respective sand particles.

The inventor herein contemplates that the primary reason bond material is lost in the sand mixing process is because the fine particles of bond material never become thoroughly wetted with water in the sand mixing process in the mullor.

The inventor contemplates that such particles do not pick up sufficient added weight of water and/or are not actively bonded to the sand to effectively inhibit the particles becoming air-borne.

In any event, that bond material which is not bonded to the sand or otherwise captured as part of the mass which defines the sand mixture can readily become air-borne because the particles are sufficiently light in weight to be moved by typical air movements in the mullor. Such air-borne particles must be removed from the air stream which passes through the processing equipment, whether at sand mixing, in the sand return system, or elsewhere in the sand system, and must be captured by dust recovery apparatus and dust recovery process steps, lest such particulate matter escape into the ambient atmosphere and thereby become air-borne particulate air pollution. The dust collection sub-systems which are attached to foundry sand systems are thus designed, configured, and operated, to collect such particles.

It is an object of this invention to reduce the quantity of bond material which must be collected by dust collection apparatus in a sand system operation.

It is another object of this invention to reduce the quantity of dust which is generated in a foundry sand system, especially in the process of making sand mixes.

It is yet another object of the invention to increase the fraction of the bond material, fed into a sand mix process, which is wetted and thereby activated in the process of making foundry sand mixes.

It is still another object of the invention to reduce the amount of unactivated bond material present in the sand mix as the sand mix is being fabricated into molds for casting metal parts.

Yet another object of the invention is to provide apparatus and methods for wetting the fresh bond material being incorporated into a sand mix, such that substantially all the fresh bond material becomes wetted, and thus does not become or remain air-borne, thus avoiding generation of substantial quantities of bond material-related dust in the process of making foundry sand mixes.

It is another object of the invention to provide apparatus and methods for making foundry sand which uses less bond material than conventional processes while developing typical bond strengths.

Another object is to provide apparatus and methods for making foundry sand mixes, which sand mixes use less bond material than sand mixes made using conventional apparatus.

Still another object is to provide a process wherein at least 75 percent by weight of the bond material fed into the process ends up as actively bonding material, bonding sand particles together, in forming molds made with the resulting foundry sand mix.

A further object is to provide novel foundry sand mix compositions.

SUMMARY

In a first family of embodiments, this invention comprehends apparatus for preparing a foundry sand mix wherein the sand mix comprises a mixture of sand and particulate bond material, for use in making sand molds to be used in casting metal parts in a foundry operation. The apparatus comprises a pre-mix tank for receiving thereinto particulate bond material and a liquid carrier therefore, and for mixing the particulate bond material and liquid carrier such as water to thereby make a slurry thereof, the pre-mix tank having a first feed port for receiving the particulate bond material into the pre-mix tank, a second separate and distinct feed port for receiving the liquid carrier into the pre-mix tank, and a discharge port for discharging the slurry from the pre-mix tank, the pre-mix tank further comprising mixing apparatus for mixing the particulate bond material and the liquid carrier to thus form the slurry; a mixer for receiving thereinto sand, liquid carrier, and particulate bond material, and for producing therefrom foundry sand mixes which can be satisfactorily bonded together by such particulate bond material so as to be operable for making foundry sand molds; and a slurry feed line for receiving the slurry from the pre-mix tank and feeding the slurry to the mixer at a feed port in the mixer.

In preferred embodiments, the apparatus includes a water feed line feeding into the slurry feed line upstream of the feed port in the mixer.

Further to preferred embodiments, the apparatus includes water spray apparatus associated with the second feed port in the pre-mix tank, the water spray apparatus being designed, configured, and positioned to apply a disperse spray of water onto a stream of bond material particles traversing an open space in the pre-mix tank.

The apparatus preferably includes a pre-mix controller for controlling quantities and timing of addition of water and bond material to the pre-mix tank.

Preferred apparatus includes a bond material hopper, and a conveyor for conveying particulate bond material from the hopper to the first feed port in the pre-mix tank.

Preferred embodiments include a water line feeding the water spray apparatus in association with the second feed port in the pre-mix tank.

Preferably, a water meter is used on the water feed line for metering desired quantities of water to the water spray apparatus such as a spray nozzle.

Preferred embodiments include a slurry pump for pumping a slurry of water and bond material from the pre-mix tank to the mixer.

In some embodiments, the mixer comprises both the feed port as a slurry entrance port for receiving slurry feed from the pre-mix tank into the mixer, and a separate and distinct fresh water entrance port for receiving fresh water into the mixer.

The slurry feed line can feed into a water feed line, and through the water feed line, into the mixer at the feed port.

In a second family of embodiments, the invention comprehends apparatus for preparing a foundry sand mix comprising a mixture of sand and particulate bond material, for use in making sand molds to be used in casting metal parts in a foundry operation. The apparatus comprises a foundry mix tank for receiving thereinto a stream of particulate bond material at a first feed port in the foundry mix tank, and expressed across an open space in the foundry mix tank; a particulate bond material feed line associated with the foundry mix tank at the first feed port, for conveying particulate foundry sand bond material to the foundry mix tank; a water feed line entering the foundry mix tank, the water feed line expressing a particulate stream of water onto such stream of particulate bond material as such stream of particulate bond material is expressed across the open space in the foundry mix tank; and a discharge port in the foundry mix tank for discharging a mixed mass of the sand, bond material, and water from the foundry mix tank.

In some embodiments, the foundry mix tank comprises a foundry sand mullor.

In other embodiments, the foundry mix tank comprises a pre-mix tank for making a slurry of water and particulate bond material, the apparatus further comprising a foundry sand mullor, and a slurry feed line for receiving slurry from the pre-mix tank and feeding the slurry to the mullor at an entrance port therefore in the mullor.

The apparatus preferably includes a pre-mix controller for controlling quantities and timing of addition of water and bond material to the pre-mix tank.

In a third family of embodiments, the invention comprehends apparatus for preparing foundry sand mixes. Such foundry sand mixes comprise mixtures of sand and particulate bond material, for use in making sand molds to be used in casting metal parts in a foundry operation. The apparatus comprises a pre-mix tank; conveying apparatus for conveying particulate bond material to the pre-mix tank using non-gaseous conveyance, and for discharging such particulate bond material into the pre-mix tank; water supply apparatus for adding water to the pre-mix tank; mixing apparatus for mixing the particulate bond material and water in the pre-mix tank to thereby make a pre-mix bond slurry; optionally, a mullor for receiving the slurry made in the pre-mix tank; and optionally a discharge line for conveying the pre-mix slurry from the pre-mix tank to such mullor.

In a fourth family of embodiments, the invention comprehends a method of preparing a foundry sand mix comprising a mixture of sand and particulate bond material thus to make a foundry sand mix suitable for use in making sand molds to be used in casting metal parts in a foundry operation. The method comprises conveying particulate bond material to a pre-mix tank using non-gaseous conveyance, and discharging the particulate bond material into the pre-mix tank; adding water to the pre-mix tank; mixing the particulate bond material and water in the pre-mix tank to thereby make a pre-mix bond slurry; adding sand to the pre-mix tank in an amount of zero up to an amount which, after the recited mixing in the pre-mix tank, results in no more than 15 percent by weight of the bond material being free bond material in the pre-mix bond slurry being discharged from the pre-mix tank; optionally conveying the pre-mix bond slurry in a discharge line to a mullor; and optionally mixing the pre-mix bond slurry with sand in the mullor to thereby make the foundry sand mix suitable for use in making sand molds to be used in casting metal parts in a foundry operation.

In some embodiments, the method includes adding no-substantial quantity of sand to the pre-mix tank.

In preferred embodiments, the method includes causing the particulate bond material to traverse a path across an open space in the pre-mix tank, and spraying water onto the stream of bond material particles so as to wet the bond material particles, without deleteriously deflecting the bond material particles from the path.

In some embodiments, the method includes specifying the absolute quantities of water and bond material to be mixed in the pre-mix tank according to test results obtained from at least one of (i) a recent batch of sand mix discharged from the mullor and (ii) return sand being fed to the mullor.

The method preferably includes feeding the slurry directly into the mullor through a dedicated slurry feed line.

Some methods include feeding the slurry through a slurry feed line to a water feed line, optionally diluting the slurry with water in the water feed line, and feeding the resulting slurry into the mullor through the water feed line.

In a fifth family of embodiments, the invention comprehends a method of preparing a mixture of sand and particulate bond material thus to make a foundry sand mix suitable for use in making sand molds to be used in casting metal parts in a foundry operation. The method comprises adding particulate bond material to a pre-mix tank; adding, to the pre-mix tank, water substantially free from the particulate bond material; mixing the particulate bond material and water in the pre-mix tank to thereby make a pre-mix bond slurry; and adding sand to the pre-mix tank in an amount of zero up to an amount which, after the recited mixing in the pre-mix tank, results in no more than 15 percent by weight of the bond material being free bond material in the pre-mix bond slurry; optionally conveying the pre-mix bond slurry from the pre-mix tank into a mullor; and optionally mixing the pre-mix bond slurry with sand in the mullor to thereby make the foundry sand mix suitable for use in making sand molds to be used in casting metal parts in a foundry operation.

In preferred embodiments, the method includes adding no substantial quantity of sand to the pre-mix tank.

In a sixth family of embodiments, the invention comprehends a method of preparing a mixture of sand and particulate bond material thus to make a foundry sand mix suitable for use in making sand molds to be used in casting metal parts in a foundry operation. The method comprises adding a first quantity of particulate bond material having a first set of bond properties and physical properties, to a pre-mix tank; adding a second quantity of water to the pre-mix tank; mixing the particulate bond material and water in the pre-mix tank to thereby make a pre-mix bond slurry; conveying the pre-mix bond slurry from the pre-mix tank to a mixer; adding sand, having a second set of bonding properties and physical properties, to the pre-mix tank in an amount of zero up to an amount which, after the recited mixing in the pre-mix tank, results in no more than 15 percent by weight of the bond material being free bond material in the pre-mix bond slurry, which slurry is being conveyed to the mixer; and mixing the pre-mix bond slurry with sand in the mixer to thereby make the foundry sand mix suitable for use in making the molds to be used in casting metal parts in a foundry operation. The resulting foundry sand mix has a capability to develop a given level of bond strength in making such sand molds while using, in the foundry sand mix, a quantity of bond material corresponding to the first quantity of particulate bond material of at least 5 percent less by weight than is needed to develop the respective level of bond strength, using corresponding sand and bond material, when adding the bond material and water, separately, directly to the mixer.

In a seventh family of embodiments, the invention comprehends a method of preparing a mixture of sand and bond particulate material thus to make a foundry sand mix suitable for use in making sand molds to be used in casting metal parts in a foundry operation. The method comprises adding a first quantity of fresh particulate bond material to a pre-mix tank; adding a second quantity of water to the pre-mix tank; mixing the fresh particulate bond material and water in the pre-mix a tank to thereby make a pre-mix bond slurry; conveying the pre-mix bond slurry from the pre-mix tank to a mixer; adding sand, and optionally used bond material, to the pre-mix tank in an amount of zero up to an amount which, after the recited mixing in the pre-mix tank, results in no more than 15 percent by weight of the bond material being free bond material in the pre-mix bond slurry, which slurry is being conveyed to the mixer; and mixing the pre-mix bond slurry with sand, and optionally used bond material, in the mixer to thereby make the foundry sand mix suitable for use in making the molds to be used in casting metal parts in a foundry operation. The quantity of particulate bond material in the so fabricated foundry sand mix represents a quantity of bond material corresponding to at least 75 percent of the first quantity of fresh particulate bond material added to the pre-mix tank.

In an eighth family of embodiments, the invention comprehends a method of reducing the fraction of active particulate bond material in dust collected from a foundry sand system, the foundry sand system containing sand, and particulate bond material. The method comprises adding particulate bond material to a pre-mix tank; adding water to the pre-mix tank; mixing the particulate bond material and water in the pre-mix tank thus to wet substantially all of the bond material with the water and to thereby form a pre-mix bond slurry wherein substantially all of the particles of bond material are active for bonding together particles of sand; discharging the pre-mix bond slurry from the pre-mix tank to a mixer; mixing the pre-mix bond slurry with sand, including with a charge of return sand mix, for example in the mixer, wherein substantially all of the bond material in the return sand mix was initially mixed with water in the pre-mix tank, to thereby make a foundry sand molding mix; and collecting air-borne dust generated in the above recited actions, including collecting air-borne particles of bond material, less than 15 percent by weight, preferably less than 10 percent by weight, of such collected dust representing active such particulate bond material.

In a ninth family of embodiments, the invention comprehends a method of reducing the fraction of inactive bond material in foundry sand molds. The method comprises adding particulate bond material to a pre-mix tank; adding water to the pre-mix tank; mixing the particulate bond material and water in the pre-mix tank thus to wet substantially all of the bond material with the water and to thereby form a pre-mix bond slurry wherein substantially all of the particles of bond material are active for bonding together particles of sand; discharging the pre-mix bond slurry from the pre-mix tank to a mixer; mixing the pre-mix bond slurry with sand, including with a charge of return sand mix, in the mixer, wherein substantially all of the bond material in the return sand mix was initially mixed with water in the pre-mix tank, to thereby make a foundry sand molding mix; and making sand molds with the sand mix so made, the fraction of the free bond material in the resulting sand molds being no greater than 15 percent by weight of the total quantity of bond material in the sand mix.

In a tenth family of embodiments, the invention comprehends a foundry sand mix. The foundry sand mix, comprises sand, particulate bond material, and water. The sand mix includes a return sand fraction having a first set of material specifications and a fresh sand fraction having a second set of material specifications. The return sand fraction comprises return sand particles and return bond material particles. The fresh sand fraction comprises fresh sand particles and fresh bond material particles. The combination of the return sand fraction and the fresh sand fraction, when mixed together at a given ratio of fresh sand to return sand, in an environment wherein the fresh sand particles and the fresh bond particles, in combination, comprise no more than 5 percent by weight water when introduced to the mix process, and wherein the fraction of fresh bond material to fresh sand particles is a base quantity by weight, and wherein the fresh bond particles are added directly to a sand composition containing no more than 3 percent by weight water, having potential to develop a first level of green sand strength when used to make a sand mold for use in foundry operations. The sand mixes of the invention, using a return sand fraction having substantially the first set of material specifications and a fresh sand fraction having substantially the second set of material specifications, have potential, when mixed together at the given ratio, to develop the first level of green sand strength with no more than 95 percent by weight, optionally no more than 90 percent by weight, of the base quantity of fresh bond material particles in the fresh sand fraction.

Figure 1:
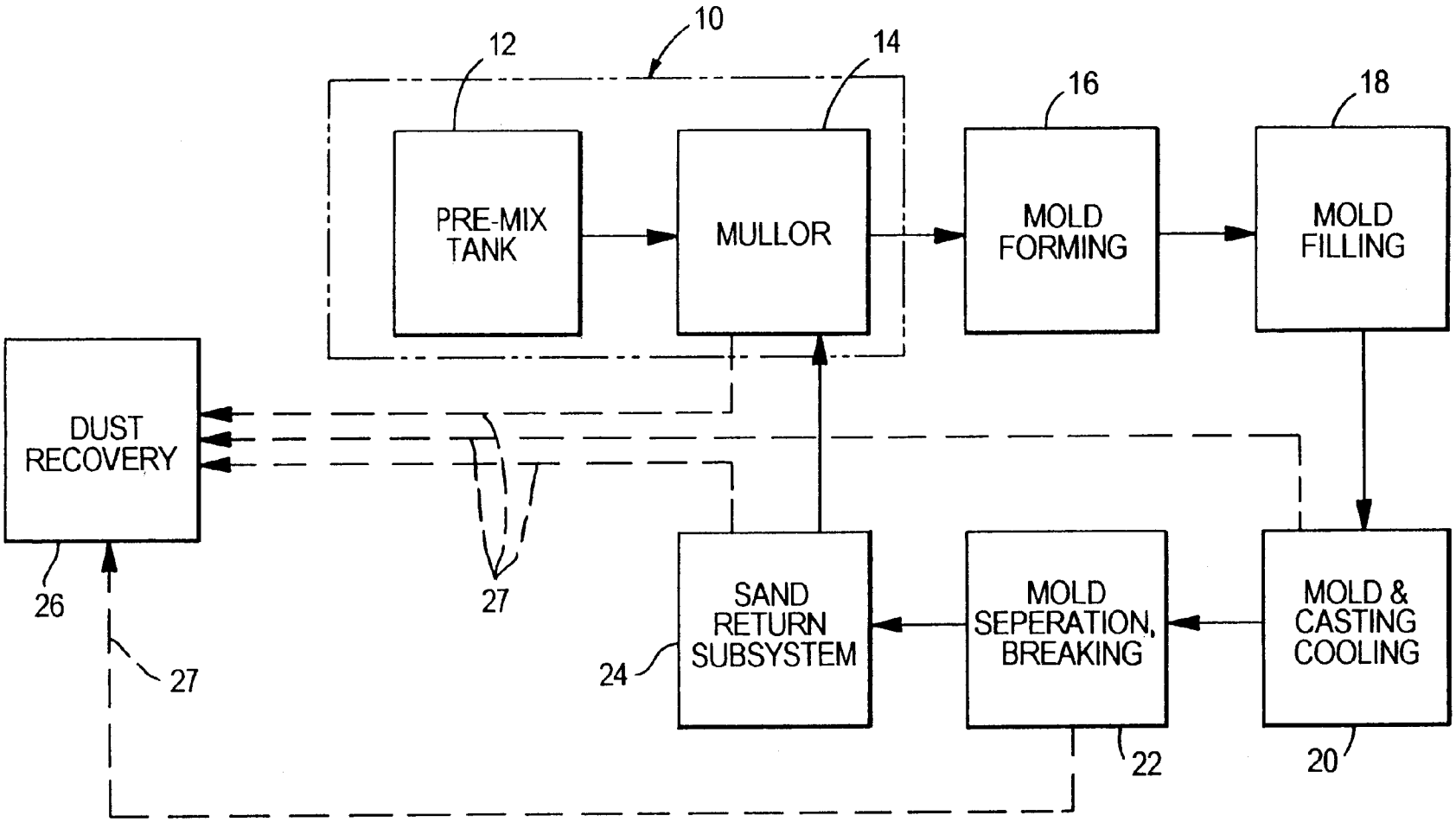
FIG. 1 shows in block diagram form the basic elements of a typical foundry sand system of the invention.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

A sand system of the invention, for making foundry sand mixes, includes a sand mixing system 10, outlined by a box defined by short and long line segments in FIG. 1. Sand mixing system 10 includes a pre-mix tank 12 and a mullor 14 or other sand mixing apparatus. Water and particulate bond material are mixed together in pre-mix tank 12 to form a pumpable slurry. The slurry is pumped or otherwise conveyed to mullor 14 where the slurry is used in making up a foundry sand mix. Typically, the slurry represents make-up quantities of water and bond material, which are added to a charge of return sand which is being reused as described hereinafter. A make-up quantity of fresh sand is also typically added to the mixture in mullor 14.

Still with reference to FIG. 1, from the mullor, the sand mix is fed to mold forming apparatus 16. The molds made at mold forming apparatus 16 are thence conveyed to mold filling apparatus 18 where molten metal is poured into the molds with use of mold cores as needed. The filled molds, and the metal contained therein, are then cooled by mold and casting cooling apparatus 20. Apparatus 20 can be, for example, a slowly moving conveyor belt, or other holding area where heat can be readily dissipated from the molds and the poured metal. Once the metal has cooled sufficiently, the molds are preferably vibrated, and are thus broken away from the cast metal parts at mold separation and breaking apparatus 22. Sand and entrained bond material, from the broken molds, then enters sand return subsystem 24 and is returned, optionally through one or more surge receptacles (not shown), to mullor 14 for re-use. The solid-line arrows between the boxes in FIG. 1 indicate the general directions of flows of the sand mix materials and the sand mix.

Various of the work stations identified above generate substantial quantities of dust. A dust recovery system 26 collects dust from the several work stations such as through dust ducts illustrated by dashed lines 27 in FIG. 1, typically receiving dust from e.g. the mullor or other mixer, the mold casting and cooling activity, mold breaking and separation, and the sand return subsystem. More, or fewer, dust ducts than those illustrated can be used as desired. Such dust, and its representation of waste, is the focus of this invention.

Figure 2:
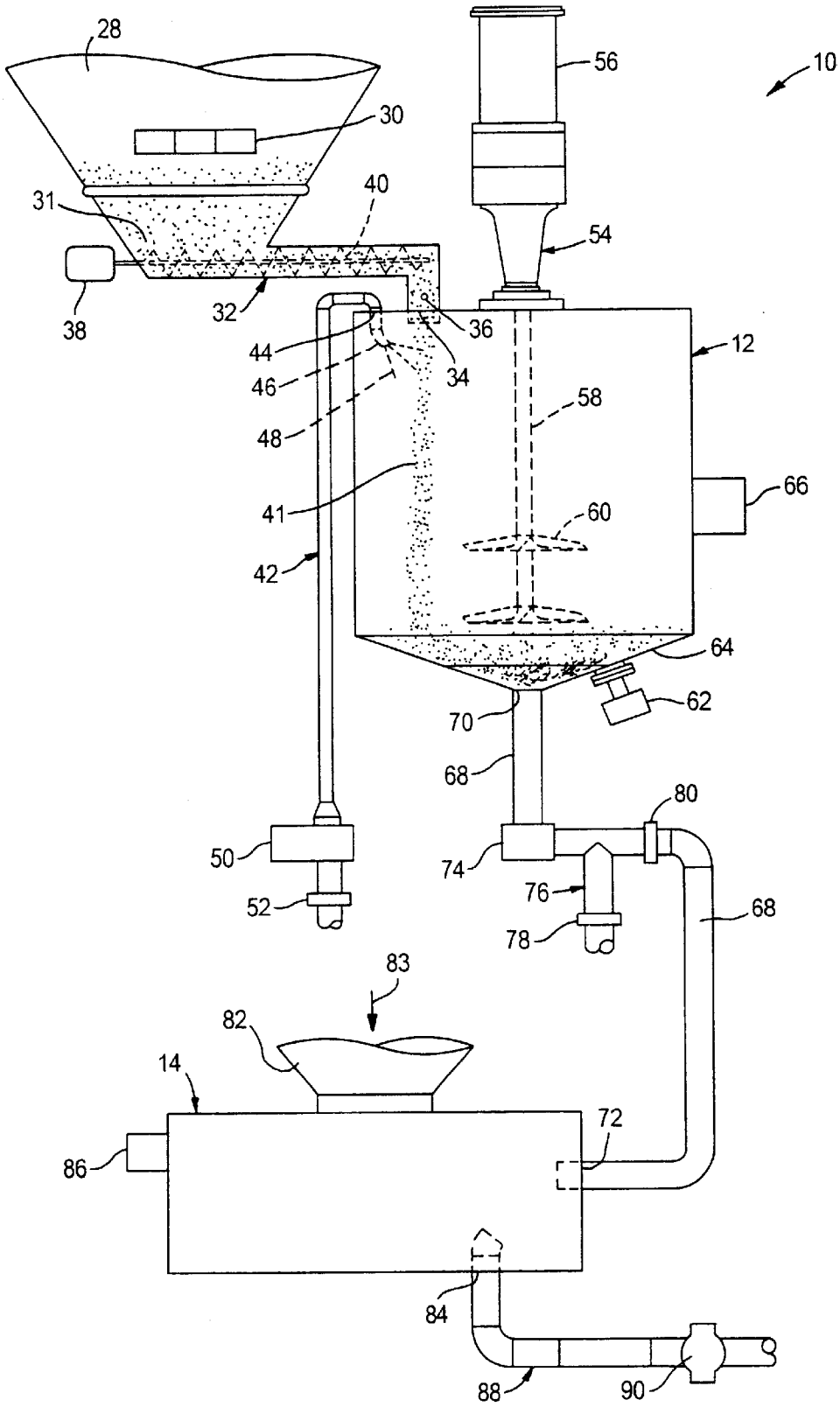
FIG. 2 shows a representative side elevation view of a sand mixing system, including pre-mix tank and mullor, of the invention.

Reference is now made to FIG. 2 and a more detailed description of sand mixing system 10. As seen in FIG. 2, a bond hopper 28, including a vibrator 30, gravity feeds bond material 31 into a screw conveyor 32 which leads to a bond material entrance port 34 at the top of pre-mix tank 12. One or more photoelectric eyes 36 at the entrance port detect the presence or absence of bond material falling through the entrance port into tank 12. If screw conveyor 32 runs for a preset time without an eye 36 detecting bond material, an alarm can be activated, or the mix cycle can be shut down for operator attention. A drive motor 38 drives screw 40 in screw conveyor 32, thus to convey the particulate bond material from the bottom of hopper 28 to bond entrance port 34, thence for dropping by gravity, past a photoelectric eye 36 for detection, and thence as a stream 41 of particulate bond material into tank 12 through the entrance port across an open space downwardly to e.g. an underlying pool of water, or previously added bond material.

A water supply line 42 feeds water into pre-mix tank 12 through water entrance port 44, which water entrance port is preferably positioned proximate bond entrance port 34 for reasons which will become clear as the description continues. Water supply line 42 leads to a nozzle 46 which is positioned, and so configured, as to apply a finely divided spray of water 48 onto falling stream 41 of bond material particles entering the pre-mix tank, so as to gently and thoroughly wet the bond material particles as the bond material enters the pre-mix tank.

Nozzle 46 can be any nozzle which can apply a gentle, well dispersed spray of water to the falling bond material particles, so as to wet the bond material particles with sufficient gentleness as to not greatly divert the falling stream of particles, but with sufficient force to project the water droplets onto the bond material particles. Exemplary of such nozzles is a VeeJet® nozzle having a capacity of 20 gallons per minute at 40 psi, and having 95 degree spray angle, supplied by Spraying Systems Company, Wheaton, Ill.

Thus, the bond material particles are well wetted by the time they get to the bottom of the tank. Such wetted particles are significantly heavier than unwetted particles, thus reducing any tendency to move laterally or upwardly and thus become air borne because of any agitation to which such particles might be subjected. Further, such wetted particles accordingly acquire increased surface tackiness properties in combination with such wetting, whereby the particles tend to stick to other surfaces, for example other bond particles or the inner surface of pre-mix tank 12 or any machinery inside tank 12. This increased tackiness thus further reduces the prospect for such particles to become air-borne. Preferably, the wetted particles drop into or onto an existing underlying pool of water or are underlying mass of previously deposited wetted particles.

Water supply line 42 further includes water meter 50 for assistance in measuring, recording, and controlling the quantity of water which enters tank 12 through the water supply line. Use of meter 50 is optional in that other methods of measuring, recording, and controlling the quantity of water can be employed.

Water supply line 42 includes valve 52 for isolating the pre-mix tank from the water supply system, for example the city water supply, or a private well supply.

Still referring to FIG. 2, a mixing device 54 extends from an externally-mounted mix motor 56 along a drive shaft 58 to a pair of sets of mixing blades 60. Blades 60 are properly positioned along the length of shaft 58 to provide for thorough mixing of the water and bond material in the tank, thus to thoroughly disperse the bond material in the water and to make a thoroughly blended slurry of the bond material and water. Any combination of drive motor, shaft, and blades can be used as mixing device 54 so long as the combination provides for thorough dispersal and wetting of the bond material, and generally uniform mixing of the bond material with the water. Exemplary of suitable such mixing device combinations are the "L" series mixing devices available from Lightnin Inc., Rochester, N.Y.

The illustrated mixing device shows two mixing blade sets, an upper blade set and a lower blade set. Blades 60 should be arrayed along shaft 58 so as to be immersed in the mixture of water and bond material for a substantial amount of the mixing time after full and typical charges of water and bond material have been added to pre-mix tank 12.

Pressure transducer 62 is mounted at bottom wall 64 of pre-mix tank 12. Transducer 62 can, in the alternative, be mounted to the side wall of tank 12, anywhere below the slurry level to be sensed as a trigger level. To the extent the transducer is mounted on the side wall, preferred locations are at or adjacent the bottom of the side wall. Transducer 62 senses the downward force exerted on the bottom wall of the tank by the weight of water and bond material in the tank, and sends suitable signals to pre-mix controller 66 through connecting communication lines (not shown).

Controller 66 is preferably a programmable logic controller, such as a user programmable Siemens S7-200PLC available from Professional Controls Corp, Germantown, Wis.

A discharge line 68 extends from discharge port 70 of the pre-mix tank to slurry entrance port 72 on mullor 14, where the slurry is delivered to the interior of the mullor receptacle. Slurry pump 74 pumps the slurry along discharge line 68 to the mullor. Exemplary of suitable slurry pumps is model T8/WAPB/NE/NE/NE available from AAAnderson, Waukesha, Wis.

A drain tap 76, having a cut-off valve 78, preferably leads to a drain downstream of pump 74, for cleaning tank 12, pump 74, and the upstream portion of discharge line 68. In the alternative, cleaning fluid from tank 12 and line 68 can be drained into mullor 14 and used in a batch of sand mix which is subsequently prepared in the mullor. Still further, tank 12, pump 74, and discharge line 68 can be cleaned in combination with cleaning the interior of mullor 14.

An isolation valve 80 is positioned downstream of drain tap 76, for the purpose of isolating pump 74 from mullor 14. A second corresponding isolation valve (not shown) can be positioned between pump 74 and discharge port 70 so as to fully isolate pump 74 from both pre-mix tank 12 and mullor 14.

Mullor 14 can be any conventionally available mullor such as the 100-B SPEEDMULLOR® available from Beardsley and Piper Division of Pettibone Corporation, Chicago, Ill. Such mullor is typically used for a batch mixing operation, whereby sequential batches of sand mix are made as needed, in support of the mold forming operation. Mullor 14 as shown includes the usual return sand entrance port 82 in the top wall of the mullor for receiving return sand from the mold separation and breaking apparatus 22, through sand return subsystem 24, as suggested by downwardly-directed arrow 83. The sand return subsystem 24 is represented in FIG. 2 by the large return pipe at sand entrance port 82. Mullor 14 further includes the usual fresh water entrance port 84 where fresh water is added to the mullor.

A typical conventional mullor such as the SPEEDMULLOR® referred to above does not have a slurry entrance port 72, whereby such entrance port can be fabricated at the use site. In the alternative, such entrance port can be specified to the mullor manufacturer when the mullor is ordered.

In a typical foundry operation, the combination of mullor 14, mold forming apparatus 16, mold filling apparatus 1 8, mold and casting cooling apparatus 20, mold separation and breaking apparatus 22, and return sand subsystem 24 operate as a generally cycling system, wherein sand and bond material are re-used with routine withdrawal of a replenishment amount of used sand mix which is typically discarded to landfill. Fractions of both the bond material and the sand are lost due to inefficiencies of the system as well as to intentional withdrawal of the replenishment amount of sand mix, and must be replenished with fresh sand and fresh bond material, along with suitable quantities of water.

Fresh sand can include regenerated sand. As used herein "regenerated" sand refers to sand which has been processed after recovery from e.g. the molding activity, such as by washing and sizing to pre-determined specifications.

Fresh bond material can include regenerated bond material particles. As used herein "regenerated" bond material refers to bond material particles which have been processed after recovery from e.g. the molding activity or dust collection, such as by washing and sizing to pre-determined specifications.

In addition, worn out fractions of both the sand and the bond material are regularly removed-from the sand system and replenished with fresh sand and bond material. Exemplary of such worn out fractions of sand and bond material is the burned-out portion of the sand/bond composite at and adjacent the metal/sand interface in the mold. Other worn out sand is commonly found in the core sand.

For example, typical sand molds are substantially more massive than the metal parts which are cast in such molds. Accordingly, the portion of the sand in the mold which is close to the poured metal, e.g. within 1–2 inches of the metal in the mold, is damaged, e.g. burned out, by the heat of the liquid metal and should be discarded when the mold is subsequently broken away. However, a significant fraction of the sand is not damaged, and can be reused to the extent such sand can be recovered and returned to the sand mix system, where the sand is reconditioned in the mullor by addition of fresh bond material, fresh sand, and water, for subsequent use in the sand system.

Typically, bond material which is mixed in with the damaged sand is similarly damaged by the heat of the poured metal, and should similarly be discarded. But again, a substantial fraction of the bond material used to make a mold is satisfactory for re-use after mold use, and after the bond material is subsequently reconditioned in the sand mix system.

Consistent with the above discussion of recycling of the sand and bond material, a typical ongoing sand system operation comprehends that, for a given size sand mix batch, a substantial fraction of the mass of the sand and bond material used in the batch is return sand which has been returned to the mullor from the metal casting operation, through sand return subsystem 24. For example, a 6000 pound batch of sand mix mixed in mullor 14 includes about 5600 pounds of return sand mix and about 200 pounds of fresh sand introduced directly into the mullor, and about 200 pounds of a slurry introduced directly into the mullor from the pre-mix tank. The slurry comprises about 150 pounds of fresh water and about 50 pounds of fresh bond material. Thus, for a 6000 pound batch of sand mix, the quantity of sand lost in the sand subsystem operation, both from inadvertent losses and from sand intentionally discarded to landfill from e.g. the surge tanks, and which is replenished in the sand mixing activity, is about 200 pounds of sand. Correspondingly, the quantity of bond material lost in such sand subsystem operation is about 50 pounds of bond material. Accordingly, the weight ratio of fresh bond material to fresh sand is about 1/4. Such ratio can vary from foundry to foundry, whereby a higher ratio such as 1/2 or 1/3 may be experienced as appropriate in some foundries, and a lower ratio such as 1/5 or 1/6 may be experienced as appropriate in other foundries.

The exact quantities and proportions of all the various sand mix ingredients will, of course, vary widely, depending especially on the quantity and condition of the return sand mix which is returned to mullor 14 by the return sand subsystem. For example, where no return sand is available, several batches of slurry are pumped to mullor 14 in order to make up a full initial batch of sand mix. An important consideration in maximizing the value of the invention is that all bond material entering the sand system should enter the system as a water slurry through pre-mix tank 12.

While it is possible that some of the bond material not enter the system as slurry through tank 12, such bond material will not benefit from the thorough wetting imparted to the bond material particles in pre-mix tank 12. As a result, the benefits of thorough wetting as taught herein may not be imparted to that fraction of the bond material, and thus the full benefits of the invention may not be achieved, though some partial benefits will be achieved to the extent some of the bond material is fed to mullor 14 as a water slurry.

It is possible to add some or all of the fresh sand to the sand system in pre-mix tank 12. However, such addition of sand to the pre-mix tank is not preferred because the purpose of the pre-mix tank is to wet the bond material, not to wet the sand. To the extent sand is introduced into the pre-mix tank, the sand competes with the bond material for the water and, because of the preference of the water for sand as compared to bond material, such addition of sand can detract from the ability of the water to attach to the bond material particles unless an excess of water is used, so as to thoroughly wet both the fresh sand particles and the fresh bond material particles. Thus, while some of the benefits of the invention can be obtained with addition of sand in the pre-mix tank, lesser benefits of the invention are typically achieved thereby, and such is therefore not preferred.

On the whole, it is preferable that return sand generally not be processed through pre-mix tank 12, though some processing of return sand in pre-mix tank 12 is possible. Whatever sand, if any, is processed in pre-mix tank 12, the sand fraction must be sufficiently small to accommodate development of a pumpable slurry wherein substantially all of the bond material particles are sufficiently wetted to become active, and thus to act in a bonding capacity, after being incorporated into the sand mix in mullor 14.

The apparatus and methods employed in the invention to provide the slurry of bond material and water to mullor 14 are preferably designed to operate in cooperation with an in-place conventional sand mix system, thereby to feed directly into a sand system already in place in the foundry. Thus, the pre-mix system receives commands from the existing conventional programmable logic controller 86 already in place as part of the conventional sand mix system. Such controller 86 controls entrance of return sand mix, fresh water, bond material, and fresh sand into mullor 14. Controller 86 can, if desired, be a controller as described above for controller 66, properly programmed to carry out the functions normally carried out for conventional mixing of sand, and suitably modified on site to accept feeds from the pre-mix system and to instruct controller 66. Such modification is readily carried out by skilled programmers readily available to foundry operators.

Typical inputs to controller 66 are as follows.

Water Increase, from controller 86

Water Decrease, from controller 86

Bond material increase, from controller 86

Bond material decrease, from controller 86

Photo eye 36 detect

Water Meter Pulse report

Pressure transducer report

Bond/water needed

Typical outputs from controller 66 are as follows.

Water valve 52 open, closed

Discharge valve 78 open, closed

Pump valve 80 open, closed

Mixer motor 56 on, off

Bond feed drive motor 38 on, off

Vibrator 30 on, off

Pump 74 on, off

A wide variety of particulate bond material compositions can be mixed according to the pre-mix teachings of this invention. A typical bond material useful in foundry systems contemplated by the invention has particles which substantially all pass through a 200 mesh screen, and has the following composition.

| Material | Weight Percent |
|---|---|
| Seacoal | 24.7 |
| Western Bentonite | 54.9 |
| Cereal | 2.25 |
| Southern Bentonite | 15.7 |
| Soda Ash | .55 |
| Low Emission Coal | 1.9 |

The sand mixing system 10 operates as follows in an ongoing sand system operation. When controller 86 determines that a fresh batch of sand mix will be needed, at an anticipated future time, at mold forming apparatus 16, a desired and defined quantity of return sand is filled into mullor 14 in the usual and conventional manner, with mixing at conventional times and durations, and at conventional speeds. Such return sand is typically more or less about 1 percent by weight water, with variations depending on the specific design of the foundry of interest.

Typically, water and bond additions are called for by conventional controller 86 for incorporation with the return sand mix in making up a fresh batch of sand mix. Controller 86 anticipates such requirement for water and bond material based on e.g. tests done on a recent previous batch released from mullor 14, in combination with known conditions of the return sand, and preferably makes up a batch of slurry ahead of any demand from controller 86 for water and especially bond material. In the alternative, because the time required for making up a batch of the slurry is relatively short, the slurry can be made up after system controller 86 calls for bond material and water.

In any event, when the slurry has been properly prepared, and controller 86 has called for bond material and water, pre-mix controller 66 opens discharge line valve 80 and starts slurry pump 74. The quantity of slurry specified by controller 86 is then pumped to mullor 14. Fresh make-up sand is also added to the mullor as needed. The slurry and fresh make-up sand are mixed with the return sand mix in mullor 14 for the usual time of about 90 to about 120 seconds, so as to make up a fresh batch of uniformly mixed sand mix, including return sand mix, fresh sand, and the slurry of water and bond material, ready for use in forming sand molds. The finished sand mix is then discharged from the mullor and transported to the mold forming apparatus. The sand mix, as discharged from the mullor, typically comprises more or less about 3 percent by weight water.

A typical discharged sand mix of the invention has an overall AFS clay content of about 10.5 percent by weight, and active clay content of about 8.5 percent by weight. Active clay content can be determined according to standard Methylene Blue tests, AFS Procedure 2210-00-S or AFS Procedure 2211-00-S. The AFS clay content can be determined by the standard AFS Clay test, AFS Procedure 2110-00-S. All such tests are set forth in the Mold & Core Test Handbook, 3d Edition, published by the American Foundry Society, Des Plaines, Ill.

Typical range of AFS clay content in the sand mix discharged from the mullor is about 5 percent by weight to about 15 percent by weight AFS clay. Preferred AFS clay content is about 10 percent by weight. By using the pre-mix step of the invention, the AFS clay fraction in the reconditioned discharged sand mix, discharged from the mullor, can be reduced by at least 0.5 percent by weight, typically by at least 1.0 percent by weight because of the thorough wetting of the fresh bond material, whereby the only source of active bond material which has latent but ineffective potential for forming bonds is bond material from the return sand used in making up the batch of sand mix. Since all of the fresh bond material is sufficiently wetted to be able to form bonds, the conventional allowance for unwetted fresh bond material is obviated, whereby the quantity of fresh bond material can be reduced by up to the amount of the conventional allowance. Thus, sand mixes of the invention can contain a smaller fraction of bond material while retaining suitable bond-forming properties.

Accordingly, for example, where a particular foundry operation typically uses sufficient bond material to provide clay content of 10.5 percent AFS clay content in the sand mix, the AFS clay content can be reduced to no more than about 10.0 percent by weight, and typically can be reduced to about 9.5 percent clay.

As another example, where the AFS clay content is e.g. 10.5 percent by weight and active clay content is 8.5 percent by weight, using conventional mixing methods, a two percent by weight allowance should normally be made in the fresh bond addition, for free bond clay material. Using the invention, such allowance can be reduced, or eliminated in specifying the quantity of bond material to be delivered to the mullor in the slurry.

Depending how much of the free bond clay is merely inactive as compared to being dead in the conventional process, the reduction in AFS clay content can be as much as 1.5 percent by weight, or even as much as 2.0 percent by weight. The actual reduction, and the absolute fraction of clay content, will vary from foundry to foundry according to the specific designs of the respective foundry, including the design of the sand system in that foundry.

In a typical foundry operation, the mullor is kept continuously busy making sand mixes, with a sand mix being discharged e.g. about every 90–120 seconds. Accordingly, the pre-mix tank must be ready to provide a slurry mixture to the mullor at the same intervals. Since the bond material and water can readily be fully mixed to make a satisfactory slurry at such intervals, pre-mix tank is preferably sized to produce a volume of slurry corresponding with the size batch of slurry material commonly requested by controller 86. Thus, assuming pre-mix controller 66 is operating in automatic mode, as soon as a batch of slurry has been delivered to mullor 14, controller 66 promptly starts to make another batch of slurry.

In that context, water spray is started at nozzle 46. The water spray is run alone for e.g. about 10–20 seconds to establish a fresh pool of water in the bottom of tank 12. Motor 38 and vibrator 30 are then started, whereby bond material feeds by gravity downwardly into screw conveyor 32 and the turning of the screw advances the bond material to bond entrance port 34, whereupon the bond material drops downwardly in a particulate stream as expressed by gravity across the open space between the top of tank 12 and the underlying material in the bottom of the tank. Such material can be, for example, only the freshly added water, or can also include a remaining portion of the previous batch of slurry.

As the bond material particles drop downwardly through the water spray emanating from nozzle 46, the finely divided spray of water coalesces on the bond material particles, whereby the weight of the water accelerates the downward fall of the particles and attenuates the tendency of such particles to deviate from the downward path due to patterns of air movement within the pre-mix tank. By breaking the water spray into finely divided particles, the water can be effectively added to the bond material particles while minimizing distraction of the bond material particles from their downward direction of traverse. Suitable such application of the water to the bond material particles can be achieved by the above described nozzle when operating at 40 psi water pressure and delivering about 20 gallons per minute of water. Where even finer dispersion of the water stream is desired, or where greater volume of water is needed, multiple nozzles can be arrayed about the location of falling stream 41 of bond material particles, thereby to deliver the desired quantity of water in multiple sprays.

Water and bond material continue to enter tank 12 until the preset water quantity (gallons per minute or gallons) and bond quantity (pounds per second or pounds) have been met. Controller 66 turns off motor 38, thereby stopping addition of the bond material to the tank, and turns off the water at valve 52 or meter 50 when the desired quantities of water and bond material have been delivered to the tank. Controller 66 turns on mix motor 56 to begin agitation, and corresponding mixing of the bond material and water in the tank. So long as the water/bond material mixture/slurry is above a pre-set mid-point level in the tank, mixer 54 runs continuously to retain the bond material particles in suspension in the water carrier.

When the slurry mixture is called for by controller 86, controller 66 opens valve 80 and starts slurry pump 74 to thereby deliver the desired quantity of slurry to mullor 14. As the slurry level drops below the pre-set mid-point level in the tank, mixer 54 is shut off.

The ratio of bond material to water in pre-mix tank 12 is about 0.5 pound to 4 pounds of bond material per gallon of water. The lower end of the range generally represents a minimum quantity of bond material which is typically added to a sand mix. The upper end of the range represents a typical limit on the viscosity of the slurry which can be readily pumped by the contemplated class of pumps used at pump 74. In addition, an even higher bond material fraction can result in insufficient wetting of the particles of bond material. Typical compositions of the slurry as pumped from pre-mix tank 12 for a 6000 pound batch of sand mix is about 16–20 gallons of water and about 30–60 pounds of particulate bond material.

Any sand which is optionally added to the slurry in the pre-mix tank typically will not disturb the ratio of water to bond material. A preferred ratio of bond material to water is about 2.5 pounds of bond material per gallon of water. In view of the above, a typical slurry of water and bond material is typically about 6 percent to about 33 percent by weight solids. Preferred solids content is about 23 percent by weight particulate bond material.

In the embodiments illustrated in FIG. 2, the usual fresh water line 88 can be used to add part of the make-up quantity of water, whereby by coordination of controller 66 and controller 86, the water addition in pre-mix tank 12 can be minimized as desired to that minimum quantity of water required to enable efficient pumping of the slurry. To that end, the usual valve 90 on fresh water line 88 can be controlled by controller 86 in adding any desired quantity of fresh water to mullor 14.

In the automatic mode, an exemplary pre-mix control system generally operates as follows. Controller 86 relays to controller 66 the amount of water and bond material needed based on tests from one or more previous batches of sand mix discharged from mullor 14. Controller 66 issues appropriate commands and water is added through the water meter for 10 seconds before addition of bond material is begun. Bond material is added using the screw conveyor, which is calibrated for the desired addition rate. While the bond material is being added, the vibrator is also running, ensuring a continuous feed of bond material to conveyor 32. After the desired quantities of bond material and water have been added to tank 12, the mixer mixes the bond material and water. When the mullor calls for a batch of slurry, controller 66 activates pump 74 and the pump runs until the desired quantity of slurry has been transferred to the mullor, for example by the making of a low limit switch. A mid limit switch is preset to start and stop the mixer, running the mixer only when the content level in the tank is at or above the pre-set mid level, so that the mix blades are not splashing the slurry about the tank.

Controller 66 then starts adding water for the next batch immediately after the transfer is terminated, e.g. the pump has stopped, and valve 80 has been closed. The cycle starts over, varying the quantities of water and bond material based on any adjustments directed by controller 86.

Figure 3:
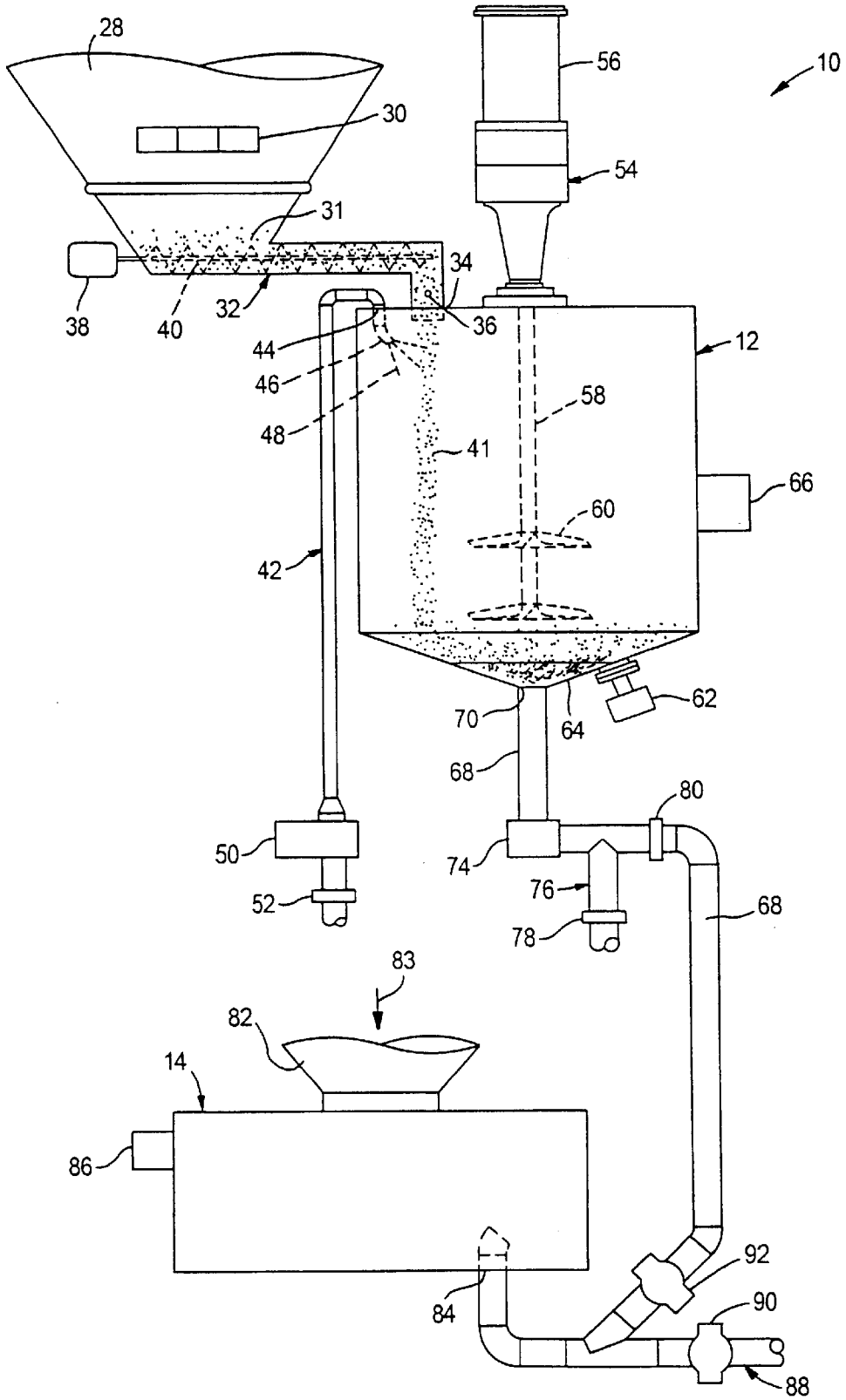
FIG. 3 shows a representative side elevation view of a second sand mixing system, including pre-mix tank and mullor, of the invention.

In an alternate embodiment, illustrated in FIG. 3, slurry line 68 from tank 12 feeds into fresh water line 88 upstream of mullor 14, rather than directly into the mullor, thus to begin the mixing of any fresh water with the slurry before the slurry enters mullor 14. Valve 92 is positioned on slurry line 68 proximate fresh water line 88 so as to provide for isolating the fresh water line from the slurry as desired. A significant advantage of the embodiments of FIG. 3 is that the slurry enters mullor 14 through conventionally-available water entrance port 84. In such case, the need to specify a slurry entrance port 72, or to cut and otherwise fabricate slurry entrance port 72 in the field, is obviated.

Whether the sand mix system is built according to FIG. 2 or FIG. 3, in either case, slurry line 68, and thus pre-mix tank 12, can be isolated from mullor 14 at will, so that the mullor can operate independently of the pre-mix tank as desired, e.g. while maintenance or repairs are being done on the pre-mix tank.

As illustrated above, the quantity of slurry mixture is based on that quantity needed for one batch of sand mix in the mullor. In the alternative, larger quantities of slurry can be made up, thus to service multiple batches of sand mix, either at a single mullor, or at multiple mullors, or to service one or more continuous mixers. In such case, the overall water requirement is fulfilled by controller 86 bringing additional water into the mullor as needed, based on the water content of the slurry. Specifically, such multiple-batch slurry can be made with less than the quantity of water anticipated to be called for by controller 86, whereby the slurry can be used with any of a variety of water quantity requests from a respective controller 86. The balance of the water not contained in the slurry is added to the mullor by controller 86, through water entrance port 84.

In a conventional process, wherein the bond material is added directly to the mullor in dry condition, it is well known that a significant fraction of such bond material does not become sufficiently wetted in the mullor for the clay in the bond material to effectively form bonds with the sand particles. In addition, that bond material which has been e.g. "burned" in previously passing through the molding process so as to no longer be effective in forming such bonds, is known as "dead" bond material. Any bond material which holds capacity to form bonds between sand particles, and which is sufficiently wetted to form such bonds, is known as "active" bond material.

A typical sand mix discharged from mullor 14 is about 3 percent by weight water. A typical return sand composition is about 1 percent weight water. Thus, the amount of water added to the composition in the mullor, including in the pre-mix slurry, is that amount necessary to cause the water content to be the desired, e.g. 3 percent, fraction for discharge from the mullor. The above percentages, of course, vary from foundry to foundry, within a well known range.

A given batch of sand mix in the mullor has a fraction of "dead" bond material, a fraction of "active" and properly wetted bond material, and a fraction of "inactive" bond material. "Inactive" bond material is bond material which is not actively able to form bonds between sand particles, but which can become active if properly wetted.

The "dead" bond material is represented by those particles of bond material which do not actively participate in the bonding activity, and will not participate in such bonding activity even when properly wetted. The "dead" bond material will not participate in the bonding activity under any feasible wetting conditions, and so its potential utility to the sand system is lost. However, the "inactive" particles can be made "active" under certain conditions.

Thus, a given sand mix typically contains "active" bond material, "inactive" bond material, and "dead" bond material. The combination of the "inactive" bond material and the "dead" bond material is that material which is "free" bond material, namely free from bonding activity. Such "free" bond material represents that bond material from which the use gains no bonding benefit. and which does not respond to the methylene blue test.

The specific thrust of this invention is to provide suitable such operating conditions which attenuate or eliminate the fraction of the inactive bond material particles by activating substantially all bond material particles. Thus, for a given foundry operation, the invention adjusts the ratio of active and wetted bond material to "inactive" bond material in favor of an increased fraction of wetted and active bond material.

By using the pre-mix apparatus and methods of the invention, substantially 100 percent of the fresh bond material particles are thoroughly wetted, and thereby do become "active" clay bond material as determined by the methylene blue test. Such active fresh bond material becomes mixed in the mullor with the bond material in the return sand, some of which is active, some of which is inactive, and some of which is dead. The active bond material in the return sand in general is believed to remain active in the mullor and to leave the mullor in an active state. A portion of the inactive sand particles in the return sand becomes properly wetted in the mullor, and thereby becomes active, so as to be able to form bonds with the sand.

By ensuring that substantially 100 percent of the fresh bond material is properly wetted, one achieves certainty that substantially all fresh bond particles, which can be activated, are activated. Accordingly, and assuming all fresh bond material particles can become active, the fraction of inactive particles in the fresh bond material is substantially zero, whereby the overall fraction of the bond material leaving the mullor as inactive bond material is decreased, with corresponding increase in the fraction of bond material which is active, assuming a constant fraction of dead bond material.

Since an increased fraction of the bond material actively participates in the bonding activity, the quantity of bond material used, namely the bond/sand ratio, can be reduced, from a base quantity of bond material which would be used absent the invention, without reducing a specified level of bonding activity. Thus, the quantity of bond material, on a dry weight basis, used in a given sand mix, to achieve a given level of bonding activity, can typically be reduced in the invention by at least about 5 weight percent, based on the overall quantity of bond material in the sand mix, from the quantity of bond material which must be used if the bond material is added to the return sand e.g. in the mullor, as dry particles. In some embodiments, bond material use can be reduced by as much as 10 weight percent or more, e.g. from 50 pounds of bond material using conventional dry bond-to-sand addition procedures, to 45 pounds of bond material using methods of the invention.

Those skilled in the art understand that the absolute bond/sand ratio varies substantially depending on a number of factors in a given operation, including the specifications of the bond material, the specifications of the sand, and the like. So the first step in assessing use and/or efficacy of the invention is to establish a base line quantity of bond material, and resulting base line bond strength, by making a sand mix wherein conventional substantially dry particles of bond material are added to the return sand conventionally in a dry state, wherein water is correspondingly added to the return sand, and the bond material and water are concurrently mixed with the return sand, all as is commonly done in conventional mullor operation. A bond material amount is thus established, which results in achieving a desired level of bonding activity in sand molds without using the invention.

Benefits of the invention are then expressed by using the methods and apparatus of the invention. If the same quantity of bond material is used, the bond strength may be increased. Correspondingly, less bond material can be used in obtaining the same base line level of bonding activity in sand molds. Such reduction in quantity/fraction of bond material used is the e.g. 5 weight percent or e.g. 10 weight percent reduction of bond material referred to above. And since the level of bond strength desired in foundry-sand molds is well established, the desired implementation of the invention typically results in obtaining a conventional base line level of bond activity while using a reduced quantity of sand, whereby novel foundry sand mixes of the invention contains less bond material, e.g. about 5 weight percent to about 10 weight percent less bond material, than conventional foundry sand mixes not of the invention.

Since less bond material is used in the sand system, less bond material is available for becoming entrained in the air and ending up in the dust recovery system. Since the bond particles which are not properly wetted in the mullor are lighter in weight, and less susceptible to forming bonds, it is such insufficiently wetted particles which are highly susceptible to becoming air-borne and entering the dust recovery system. And since a greater fraction of the bond material is thoroughly wetted in the sand mixing system of the invention, an overall smaller fraction of the bond material particles in the discharged sand mix are susceptible to becoming air-borne in the sand system. Collectively, the load on the dust recovery system is reduced, reducing the quantity of material which must be recovered and/or land filled from the dust recovery system, potentially reducing the quantity of escaped air-borne dust which is produced by the foundry operation, and reducing the quantity of bond material which must be purchased for use in the sand system.

In an exemplary conventional dust recovery system in a conventional foundry operation, about 35 percent to about 40 percent of the dust collected is clay from the bond material composition. Approximately 60 percent of the clay collected in the dust collection system is "active" clay, representing a loss of potentially useful bond material clay. By utilizing the pre-mix methods of the invention, the absolute quantity of clay recovered in the dust recovery system is less, as is the fraction of the recovered clay which is "active" clay.

As used herein the phrase "pre-mix bond slurry" includes pre-mix bond mixtures which include the optional quantities of sand therein, whereby the resulting pre-mix may not fit the classical definition of "slurry," in that such mixture may not exhibit common liquidous free flow properties, and whereby suitable alterations are made to the apparatus and methods disclosed herein for transfer of the pre-mix composition from tank 12 to mullor 14.

As used herein "active" bond material is bond material which, when properly wetted, can be effectively used to bond together at least two particles of sand according to the methylene blue test.

As used herein "dead" bond material is bond material which cannot be effectively used to bond together at least two particles of sand even if properly wetted and which does not respond as "active" bond material to the methylene blue test.

As described herein, the mullor is used as a mixing vessel for mixing the slurry with a primary charge of return sand, as well as any additional water and/or fresh sand. Those skilled in the art will understand that a wide variety of mixing apparatus can be used for such mixing activity. The mullor is representative of batch-type mixers. There can also be mentioned, for example, continuous mixers. What is important is that the mixing apparatus satisfy the requirement that the sand, bond material, water, slurry, and other ingredients appropriate to foundry sand mixes, be suitably mixed for use in making foundry sand molds.

Similarly, the pre-mix tank is merely representative of batch mixers. There can also be mentioned continuous mixers, static mixers, and the like. What is important is that the pre-mix apparatus satisfy the requirement that the bond material and water be suitably mixed for conveyance as a uniform mixture to the mix/mullor apparatus which mixes the slurry with the remaining ingredients.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. Apparatus for preparing a foundry sand mix comprising a mixture of sand and particulate bond material, for use in making sand molds to be used in casting metal parts in a foundry operation, said apparatus comprising:

(a) a pre-mix tank for receiving thereinto particulate bond material and a liquid carrier therefore, and for mixing such particulate bond material and liquid carrier to thereby make a slurry thereof, said pre-mix tank. having a first feed port for receiving such particulate bond material into said pre-mix tank, a second separate and distinct feed port for receiving such liquid carrier into said pre-mix tank, and a discharge port for discharging such slurry from said pre-mix tank, said pre-mix tank further comprising driven mixing apparatus for mixing such particulate bond material and such liquid carrier to thus form such slurry;

(b) a mixer for receiving thereinto sand, liquid carrier, and particulate bond material, and for producing therefrom foundry sand mixes which can be satisfactorily bonded together by such particulate bond material so as to be operable for making foundry sand molds; and (c) a slurry feed line for receiving such slurry from said pre-mix tank and feeding such slurry to said mixer at a feed port in said mixer.

2. Apparatus as in claim 1, including a water feed line feeding into said slurry feed line upstream of said feed port in said mixer.

3. Apparatus as in claim 1, including water spray apparatus associated with said second feed port in said pre-mix tank, said water spray apparatus being designed, configured, and positioned to apply a disperse spray of water onto a stream of bond material particles traversing an open space in said pre-mix tank.

4. Apparatus as in claim 1, including a pre-mix controller for controlling quantities and timing of addition of water and bond material to said pre-mix tank.

5. Apparatus as in claim 1, including a bond material hopper, and a conveyor for conveying particulate bond material from said hopper to the first feed port in said pre-mix tank.

6. Apparatus as in claim 3, including a water line feeding said water spray apparatus in association with the second feed port in said pre-mix tank.

7. Apparatus as in claim 6, including a water meter on said water feed line for metering desired quantities of water to said water spray apparatus.

8. Apparatus as in claim 1, including a slurry pump for pumping a slurry of water and bond material from said pre-mix tank to said mixer.

9. Apparatus as in claim 1, said mixer comprising both a fresh water feed port for receiving fresh water into said mixer, and a separate and distinct slurry feed port for receiving slurry feed from said pre-mix tank.

10. Apparatus as in claim 1, said slurry feed line feeding into a water feed line, and through said water feed line, into said mixer at said feed port.

11. Apparatus for preparing a foundry sand mix comprising a mixture of sand and particulate bond material, for use in making sand molds to be used in casting metal parts in a foundry operation, said apparatus comprising:

(a) a foundry mix tank for receiving thereinto a stream of particulate bond material at a first feed port in said foundry mix tank, and expressed across an open space in said foundry mix tank;

(b) a particulate bond material feed line associated with said foundry mix tank at said first feed port, for conveying particulate foundry sand bond material to said foundry mix tank;

(c); a water feed line,entering said foundry mix tank, said water feed line expressing a particulate stream of water onto to such stream of particulate bond material as such stream of particulate bond material is expressed across the open space in said foundry mix tank; and (d) a discharge port in said foundry mix tank for discharging a mixed mass of such sand, bond material, and water from said foundry mix tank.

12. Apparatus as in claim 11 wherein said foundry mix tank comprises a foundry sand mullor.

13. Apparatus as in claim 11 wherein said foundry mix tank comprises a pre-mix tank for making a slurry of water and particulate bond material, said apparatus further comprising a foundry sand mullor, and a slurry feed line for receiving such slurry from said pre-mix tank and feeding such slurry to said mullor at an entrance port therefore in said mullor.

14. Apparatus as in claim 13, including a pre-mix controller for controlling quantities and timing of addition of water and bond material to said pre-mix tank.

15. Apparatus as in claim 11, including a bond material hopper, and a conveyor for conveying particulate bond material from said hopper to the first feed port in said foundry mix tank.

16. Apparatus as in claim 11, including a water meter on said water feed line for metering desired quantities of water to said water spray apparatus.

17. Apparatus for use in preparing foundry sand mixes, such foundry sand mixes comprising mixtures of sand and particulate bond material, for use in making sand molds to be used in casting metal parts in a foundry operation, said apparatus comprising:

(a) a pre-mix tank;

(b) conveying apparatus for conveying particulate bond material to said pre-mix tank using non-gaseous conveyance, and for discharging such particulate bond material into said pre-mix tank;

(c) water supply apparatus for adding water to said pre-mix tank; and (d) mixing apparatus for mixing the particulate bond material and water in said pre-mix tank to thereby make a pre-mix bond slurry.

18. Apparatus as in claim 17, including water spray apparatus in said pre-mix tank designed and positioned to apply a disperse spray of water onto a stream of bond material particles traversing an open space in said pre-mix tank.

19. Apparatus as in claim 17, including a pre-mix controller for controlling quantities and timing of addition of water and bond material to said pre-mix tank.

20. Apparatus as in claim 18, including a water line feeding said water spray apparatus through a feed port in said pre-mix tank.

21. Apparatus as in claim 20, including a water meter on said water feed line for metering desired quantities of water to said water spray apparatus.

22. Apparatus as in claim 17, and further comprising (e) a mullor for receiving such slurry made in the pre-mix tank, and (f) a discharge line for conveying such pre-mix slurry from said pre-mix tank to such mullor.

23. Apparatus as in claim 22, including a slurry pump for pumping a slurry of water and bond material from said pre-mix tank to said mullor.

24. Apparatus as in claim 22, said mullor further comprising both a fresh water feed port for receiving fresh water into said mullor, and a separate and distinct slurry feed port for receiving slurry feed from said pre-mix tank.

25. Apparatus as in claim 22, said discharge line feeding into a water feed line, and through said water feed line, into said mullor at the feed port.

* * * * *

UNITED STATES PATENT AND TRADEMARK OFFICE

CERTIFICATE OF CORRECTION

PATENT NO. : 6,435,262 B1 
DATED : March 16, 2002
INVENTOR(S) : Dwayne Alan McVane It is certified that error appears in the above-identified patent and that said Letters Patent is hereby corrected as shown below:

Column 2,
Line 26, delete “of-air-borne” and insert -- of air-borne -- in place thereof.

Column 3,
Line 18, delete “threshhold” and insert -- threshold -- in place thereof.
Line 23, after the word “the”, delete “.”.

Column 6,
Line 57, delete “no-substantial” and insert -- no substantial -- in place thereof.

Column 8,
Line 1, after the word “pre-mix”, delete “a”.

Column 12,
Line 22, delete “1 8”, and insert -- 18 -- in place thereof.
Line 44, delete “removed-from”, and insert -- removed from -- in place thereof.

Column 18,
Line 66, after the word “benefit”, delete “.”.

Column 20,
Line 6, delete “foundry-sand” and insert -- foundry sand -- in place thereof.

Column 21,
Line 34, after the word “tank”, delete “.”.

Column 22,
Line 26, after “(c)”, delete “;”.

Signed and Sealed this

Fourth Day of February, 2003

JAMES E. ROGAN
*Director of the United States Patent and Trademark Office*